US005459928A

United States Patent [19]

Lynn et al.

[11] Patent Number: 5,459,928

[45] Date of Patent: Oct. 24, 1995

[54] CABINET SCRAPER HOLDER

[75] Inventors: John S. Lynn; Leonard G. Lee, both of Ottawa; Lloyd Sevack, Nepean, all of Canada

[73] Assignee: Lee Valley Tools Ltd., Ottawa, Canada

[21] Appl. No.: 105,396

[22] Filed: Aug. 12, 1993

[51] Int. Cl.[6] ..... B27G 17/04

[52] U.S. Cl. ..... 30/169; 30/312; 30/314; 30/333; 30/335; 15/236.07; 144/115

[58] Field of Search ..... 30/169, 170, 171, 30/172, 280, 281, 294, 312, 489, 492, 484, 485, 486, 487, 314, 315, 317, 329, 330, 332, 333, 335; 144/115; 29/78, 80

[56] References Cited

U.S. PATENT DOCUMENTS

| | | | |
|---|---|---|---|
| 305,603 | 9/1884 | Keiser | 30/169 |
| 821,525 | 5/1906 | Nordquist | 30/169 X |
| 1,264,350 | 4/1918 | Unsinger | 15/236.07 X |
| 1,618,604 | 2/1927 | Riggs | 30/485 X |
| 2,655,721 | 10/1953 | Einhorn | 30/172 X |
| 2,682,699 | 7/1954 | Merrill | 29/80 |
| 2,693,029 | 11/1954 | Kass | 30/171 X |
| 3,523,348 | 8/1970 | Nilsson | 29/80 X |
| 3,710,467 | 1/1973 | Coon et al. | 29/80 |
| 3,763,531 | 10/1973 | Dancsik | 29/80 |
| 3,983,595 | 10/1976 | Knudsen et al. | 30/169 X |

FOREIGN PATENT DOCUMENTS

| | | | |
|---|---|---|---|
| 554421 | 3/1958 | Canada | 15/236.07 |
| 149704 | 12/1951 | Sweden | 30/169 |
| 134377 | 1/1952 | Sweden | 29/80 |

OTHER PUBLICATIONS

Highland Hardware Catalog titled *Woodworking Tools, Books & Supplies Fall 91/Winter 92 Catalog*, p. 83, item numbered "T".

Highland Hardware Catalog titled *Woodworking Tools, Books & Supplies Fall 91/Winter 92 Catalog*, p. 83, item numbered "U".

Highland Hardware Catalog titled *Woodworking Tools, Books & Supplies Fall 91/Winter 92 Catalog*, p. 83, item numbered "V".

"Shop Solutions, Scraper Holder," *ShopNotes*, Issue 3, p. 26.

*Primary Examiner*—Rinaldi I. Rada
*Assistant Examiner*—Clark F. Dexter
*Attorney, Agent, or Firm*—Kilpatrick & Cody

[57] ABSTRACT

A holder for conventional rectangular cabinet scrapers having a body shaped like an open scroll, pivoting structures within each scroll-like end of the body to grasp a scraper blade along a substantial portion of its entire end, and a centrally located padded pressure plate adjustable with a thumb screw to apply pressure to one face of the cabinet scraper in order to bow it away from the body.

14 Claims, 3 Drawing Sheets

CABINET SCRAPER HOLDER

BACKGROUND OF THE INVENTION

This invention relates to cabinet scrapers utilized in woodworking.

Cabinet scrapers have long been utilized in woodworking for removing small amounts of wood or finish from work surfaces, typically for the purpose of smoothing such surfaces. Such scrapers may be fabricated of an appropriate grade of steel in a variety of shapes, but are typically approximately five or six inches wide, approximately 2½ inches tall and on the order of 0.015 to 0.042 inches thick. Scrapers are prepared for use by forming a "hook" on one or more working edges. In use they are drawn or pushed along a workpiece while held at an angle to the workpiece and slightly bowed in the direction of travel.

While cabinet scrapers can be used with great success while holding them with the user's fingers, doing so is tiring and, particularly in the case of thicker scrapers, requires substantial strength and stamina to keep the scraper bowed. Additionally, friction between the scraper and work surface heats the scraper to an uncomfortable temperature that is sometimes high enough to burn the user's thumbs. Finally, under normal circumstances two hands are required to use a conventional cabinet scraper.

Perhaps in part because of these problems, scraper "planes" have also long been used in which a scraping blade is held in a plane-like or spoke shave-like holder that has a sole which bears against the work surface. The width of the scraper blade used in such devices is typically no more than approximately three inches, and the blade is typically bowed with a thumbscrew that bears against the back of the blade. Such scraper planes are expensive and cannot be used successfully in certain applications because of, among other reasons, the presence of the sole, narrow blade width and tendency for the blade to chatter. The angle between the scraper blade and sole (and, therefore, workpiece surface) is fixed in many such devices. While it is adjustable in others, such adjustment is not possible during use of any such devices. By contrast, a hand-held scraper blade can simply be tilted a different amount during use, even during a single scraping stroke.

A shop-fabricated fixture for holding a cabinet scraper has previously been suggested in *Shop Notes*, issue 3, (1992) at page 26. In this device, which is basically a simple block of wood, a single screw in direct contact with the scraper bows the blade, which is fixed to the block of wood by one wood screw and washer at each end of blade. This device does not support a substantial portion of the ends of the scraper, is difficult to adjust, and frequently chatters in use.

There is, therefore, a need for a cabinet scraper holder superior to the hand held methods and previously known fixtures.

SUMMARY OF THE INVENTION

The present invention is a holder for conventional rectangular cabinet scrapers. It has a body with a shape reminiscent of an open scroll, pivoting structures within each end of the body to grasp a scraper blade along a substantial portion of its entire end, and a centrally located padded pressure plate adjustable with a thumb screw to apply pressure to the face of the cabinet scraper in order to bow it away from the body.

It is therefore an object of the present invention to provide a holder for a conventional rectangular cabinet scraper that is superior to those previously known and offers advantages over the use of such a cabinet scraper while held in the user's hands.

It is an additional object of the present invention to provide a scraper holder that makes it possible to use a scraper successfully with one hand, makes it possible to use a scraper in situations where prior art scraper planes will not function successfully and is economical and easy to use and adjust.

These and other features and benefits of the present invention will be more fully appreciated by reference to the drawings and the following detailed description of those drawings and claims.

DETAILED DESCRIPTION OF THE DRAWINGS

Figure 1:
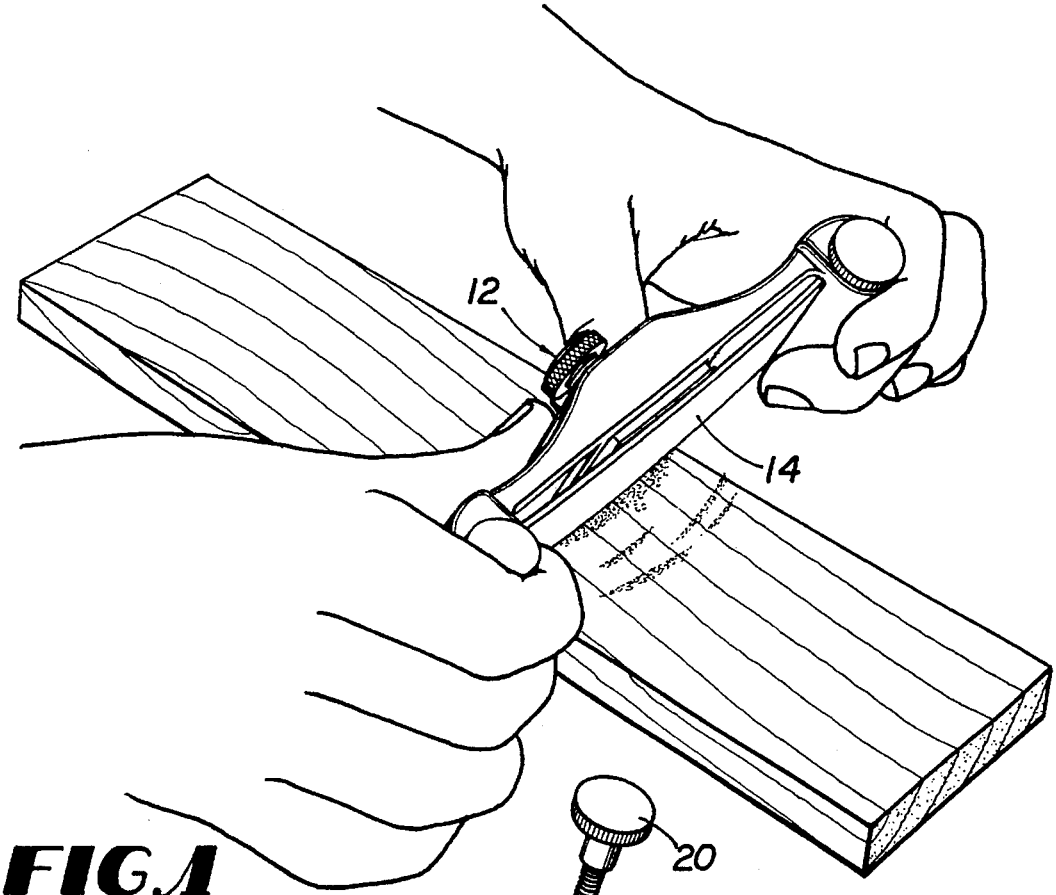
FIG. 1 is a perspective view of the cabinet scraper holder of the present invention shown in use being pushed away from the user along the surface of a workpiece.

The holder 12 of the present invention for a cabinet scraper or blade 14 comprises generally (as is well illustrated in FIG. 2) a body 16, two locking cones 18 for securing the ends 15 of blade 14 in the body 16, cone locking thumb screws 20, a pressure plate 22 that acts against a pressure pad 24 to bow blade 14 when plate thumb screw 26 is rotated within body 16, and a retaining washer 28 for holding pressure plate 22 on the end 30 of plate thumb screw 26.

Figure 2:
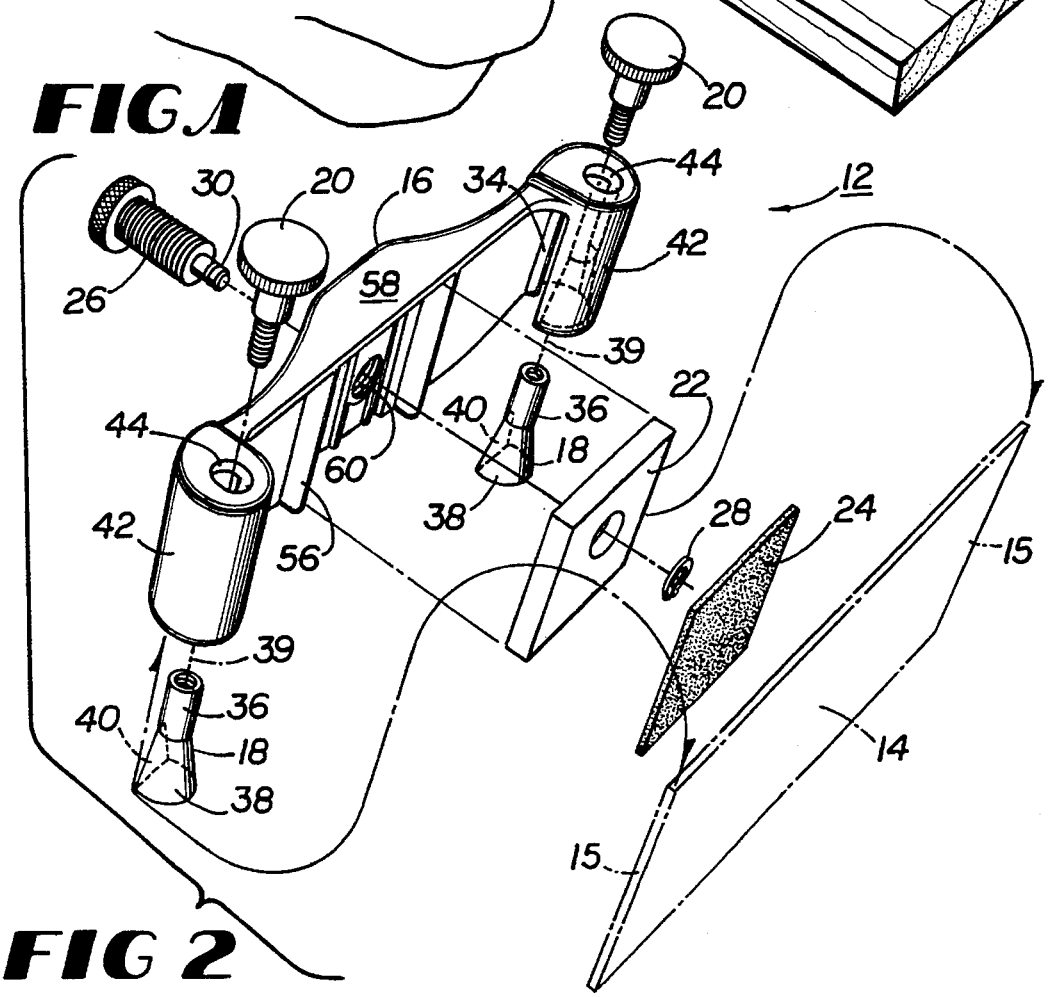
FIG. 2 is an exploded perspective view of the cabinet scraper holder shown in FIG. 1 showing its top, front and right side.
Figure 3:
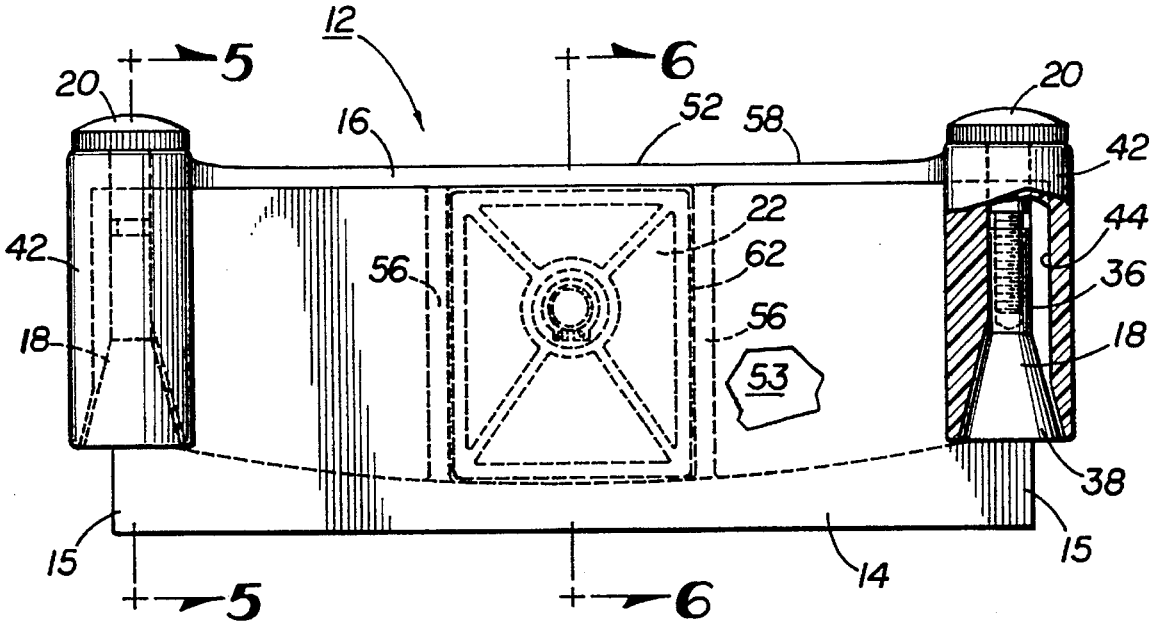
FIG. 3 is a front elevation view of the scraper holder shown in FIG. 1 with a portion of the holder body broken away to show underlying structure and with structure lying behind the cabinet scraper blade indicated in broken lines.
Figure 4:
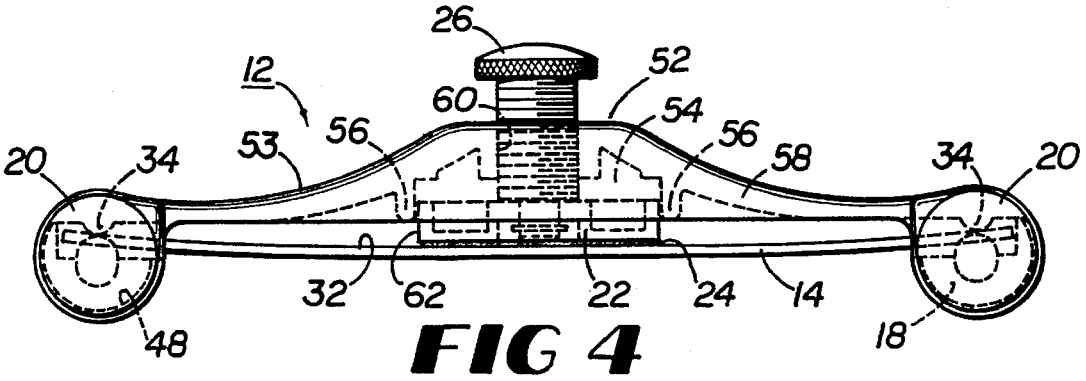
FIG. 4 is a top plan view of the cabinet scraper blade holder of FIG. 1 with internal structure indicated in broken lines.
Figure 5:
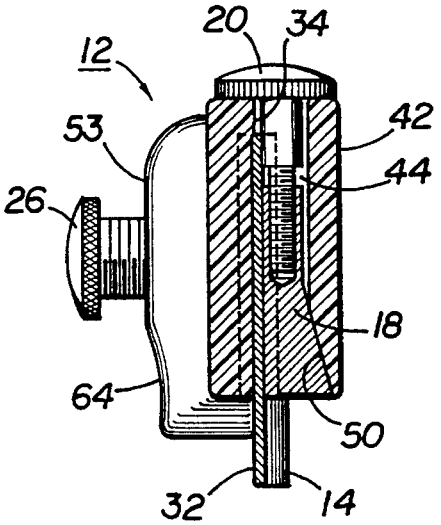
FIG. 5 is a cross-sectional view taken along line 5—5 in FIG. 3.
Figure 6:
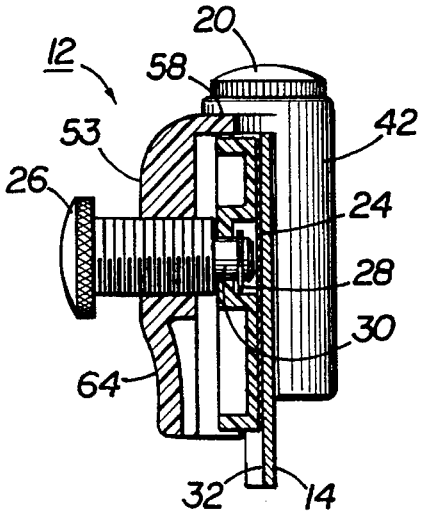
FIG. 6 is a sectional view taken along line 6—6 in FIG. 3.

The structures for securing ends 15 of scraper 14 in holder 12 can best be understood by reference to FIGS. 3, 4 and 5. The back side 32 of scraper 14 near each end 15 lies against an upstanding rounded ridge 34 in body 16 that can be seen on the right side of body 16 in FIG. 2, and is shown in broken lines in FIG. 4 and in section in FIG. 5. These ridges 34 provide surfaces of body 16 against which portions at the end 15 of scraper 14 can lie, regardless of the extent of which scraper 14 is bowed (within the limits permitted by scraper holder 12).

Ends 15 of scraper blade 14 are urged against ridges 34 by locking cones 18 when such cones 18 are drawn into body 16 by rotating thumb screws 20. As is illustrated in FIGS. 2, 3 and 5, locking cones 18 comprise an internally threaded barrel 36 joined to a truncated cone 38 from which a segment has been removed, leaving a face parallel with the axis 39 of threaded barrel 36.

As is visible on the right side of body 16 in FIG. 1, body 16 has a scroll end 42 formed with a bore 44 to receive thumb screw 20 and a tapered cone-receiving surface 50 having the same taper as cone 38 of locking cone 18. Scroll end 42 is capable of receiving locking cone 18 (as is illustrated by the broken line 48 in FIG. 4) in a range of rotational positions corresponding to the desired range of possible bows in blade 14. As will be appreciated by one Skilled in the art, particularly by reference to FIGS. 3 and 5, rotation of thumb screw 20 to draw locking cone 18 into body 16 will force contact surface or face 40 against blade 14 and thereby force blade 14 against ridge 34 as the wedging action between surface 50 of body 16 and cone 38 occurs.

Midsection 52 of the body 16 swells toward the back 53 of holder 12 in order to provide a recess 54 for receiving pressure plate 22. Recess 54 is defined by vertical ribs 56 and the top 58 of body 14. As will be appreciated by reference to FIGS. 3 and 4, pressure plate 22 may be moved in and out of recess 54 by rotation of thumb screw 26 that is journalled in a threaded hole 60 in body 16. As is illustrated by FIG. 3, pressure plate 22 is constrained by ribs 56 and top 58 from rotating as thumb screw 26 drives pressure plate 22 in and out of recess 54. Pressure pad 24, which may be cork, rubber, cork/rubber composite, or any other suitable resilient material, prevents pressure plate 22 from damaging scraper 14 and equalizes pressure exerted on scraper 14. Pad 24 also increases the friction between an extended scraper blade 14 and the pressure plate 22, thereby cooperating with locking cones 18 in preventing scraper blade 14 from sliding upward during use.

Notwithstanding inclusion of pad 24, the relatively substantial width of pressure plate 22 nevertheless results in exertion of pressure against scraper blade 14 along two vertical lines corresponding to the vertical edges 62 of pressure plate 22. These vertical lines roughly correspond to the typical positions of a user's thumbs during normal utilization of a cabinet scraper blade without the holder of the present invention.

Concave indentations 64 in the back side 53 of body 16 provide convenient thumb positions during use of the scraper.

Holder 12 is utilized by loosening the locking cones 18 by rotating cone thumb screws 20 and holding the holder 12 inverted so that cone thumb screws 20 are pressed against the body 16 (thereby insuring that locking cones 18 are released.) The blade 14 is then slipped in position until it projects a desired amount from the body 16 or encounters the top 58 of body 16.

While continuing to hold the body 16 inverted, the two cone thumb screws 20 are released, allowing the locking cones to slide along blade 14 and lock into place against surfaces 50. Each thumb screw 20 is then rotated until cones 18 barely hold blade 14 in position. Then plate thumb screw 26 is rotated in order to advance pressure plate 22 and pressure pad 24 against the back side 32 of blade 14 until it has been bowed by the amount desired. Finally, cone thumb screws 20 are rotated to snugly secure the ends 15 of blade 14 in holder 12.

After a blade 14 is mounted into holder 12 it may be pushed along a work surface as is illustrated in FIG. 1 with the user's fingers wrapped around the scroll ends 42 of body 16 and thumbs positioned in the recesses 64 of body 16. The apparatus may also be pulled toward the user utilizing two hands in any comfortable position. Of particular significance, a scraper 14 held in holder 12 may be successfully used by pulling it with one hand, which is not possible with a scraper blade 14 alone, since such a blade cannot normally be bowed with one hand.

Figure 7:
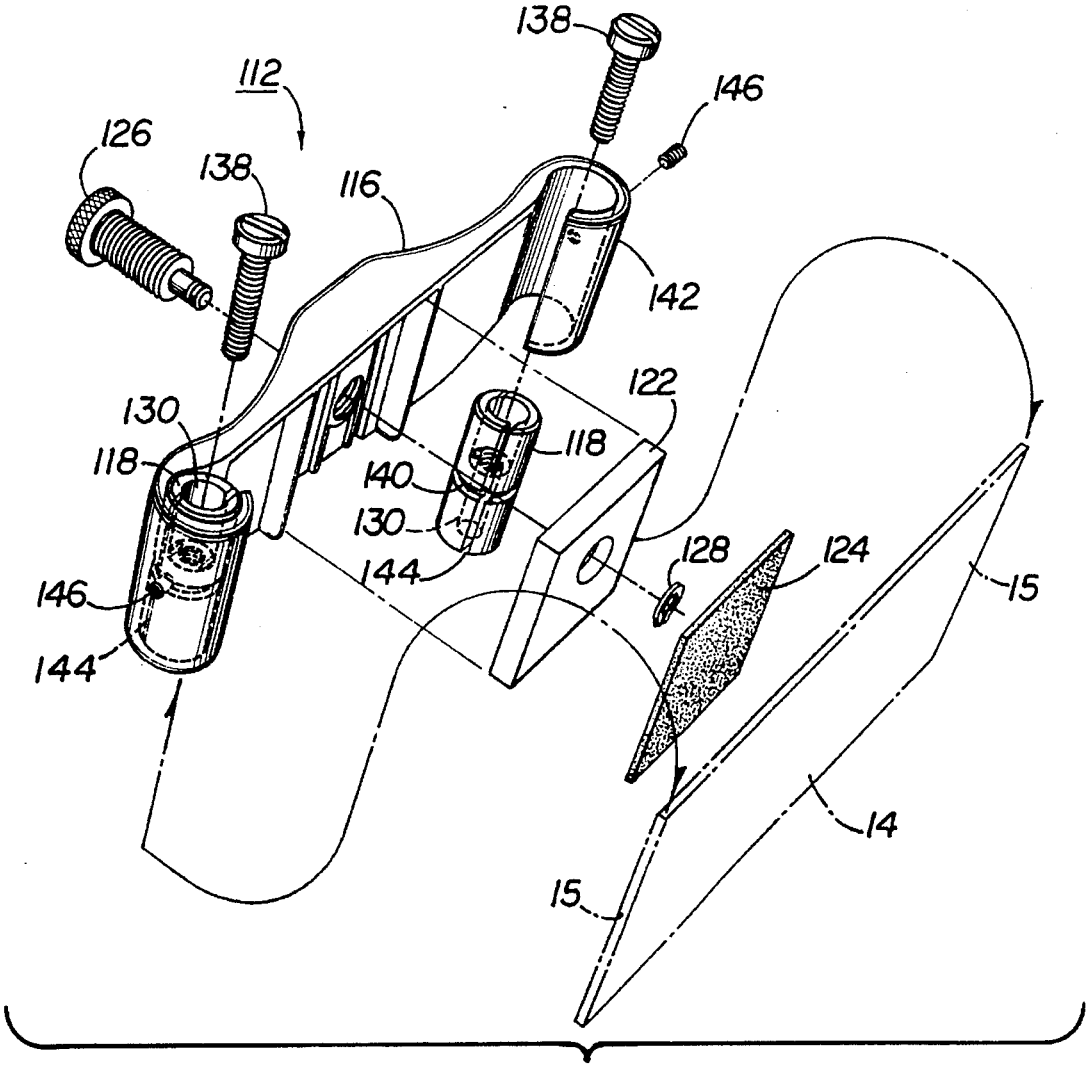
FIG. 7 is an exploded perspective view of an alternative embodiment of the cabinet scraper holder of the present invention.
Figure 8:
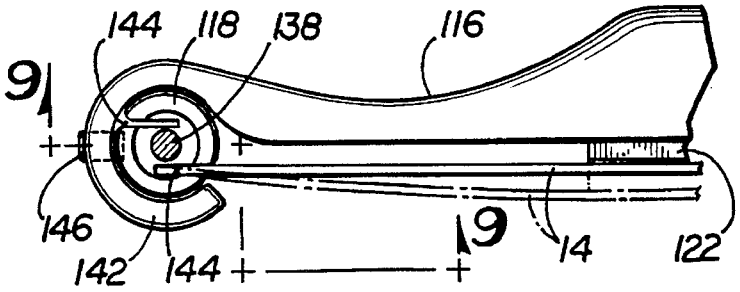
FIG. 8 is a bottom plan view of a portion of the cabinet scraper holder shown in FIG. 7.
Figure 9:
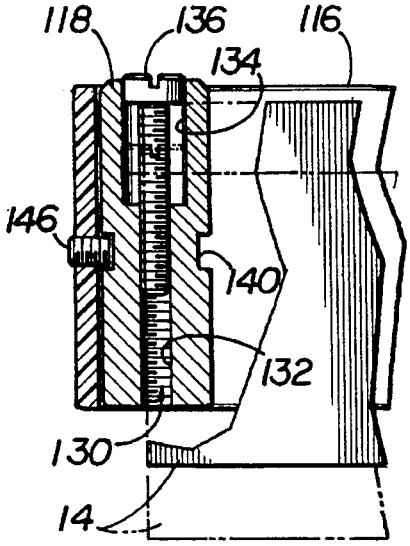
FIG. 9 is a sectional view taken along line 9—9 in FIG. 8.

An alternative embodiment of the cabinet scraper holder of the present invention is illustrated as holder 112 in FIGS. 7, 8 and 9. As will be appreciated by reference to FIG. 7, holder 112 comprises generally a body 116 having a scroll-like shape similar to the body 16 of the first embodiment, cylinders 118 that receive the ends 15 of blade 14, a pressure plate 122 and pressure pad 124 that is pressed against the back side 32 of blade 14 by a plate thumb screw 126. Each cylinder 118 has an axial bore 130 that is threaded along a lower portion 132 and is of larger diameter along a second portion 134 in order to receive the head 136 of a cap screw 138 that is received in the bore 130. Each cylinder 118 has a centrally located annular groove 140 so that, when cylinder 118 is received in a scroll end 142 of body 116, cylinder 118 can be captured therein by a set screw 146 threaded into the scroll end 142 of body 116 and received in annular groove 140. Each cylinder 118 carries at least one and preferably two, longitudinal slots 144 for receiving the ends 15 of blade 14. Each of these slots may be of a different width appropriate to receive a blade 14 of a desired thickness. As is illustrated in FIG. 8, each slot 144 is located on a line that subtends less than 180 degrees of the circle visible when the end of cylinder 118 is viewed, as in FIG. 8, so that each slot 144 can extend from the cylinder 118 surface past the longitudinal axis of cylinder 118.

As is illustrated by the solid and broken lines in FIG. 9, projection of the scraper blade 14 from the bottom of holder 112 is established by the position of cap screw 138 that acts as a stop within cylinder 118. Adjustment of the amount of bowing in blade 14 is accomplished in the alternative embodiment holder 112 in the same manner as is described above.

As will be readily appreciated by one skilled in the art, the components of the scraper holder of the present invention can be fabricated from a variety of appropriate materials. For instance, bodies 16 and 116 may be machined or cast from metal, plastic or composite materials. A preferred composite material is thirty percent (30%) glass fiber filled nylon. The configuration of the scraper holder of the present invention can also assume numerous alternative shapes. In particular, holder bodies 16 and 116 can assume a wide variety of shapes. As will be readily apparent to one skilled in the art, shapes that have relatively uniform cross sections can be most easily cast or molded in metals and plastics because of consequent reduction in adverse effects associated with differential cooling of portions of the component.

The foregoing description of this invention is for purposes of explanation and illustration. It will be apparent to those skilled in the art that modification and changes may be made to this invention without departing from the scope and spirit of the following claims.

We claim:

1. Apparatus for holding a rectangular cabinet scraper during use of the scraper on a workpiece, the scraper having a front side, a back side, top and bottom edges separated by a scraper height, and two ends, the apparatus comprising scraper holding means for holding the ends of the scraper by contact with both the front side and back side of the scraper along a substantial portion of the scraper height so that the bottom scraper edge projects from the apparatus between the scraper holding means, and means for bowing the scraper for use with contact solely between the scraper and the workpiece, wherein the means for bowing is adjustable to permit a range of different amounts of bowing and wherein the scraper holding means is capable of rigidly holding the ends throughout the range of different amounts of bowing, wherein the apparatus includes a body with at least two indentations to receive a user's thumbs during use of the apparatus.

2. Apparatus for holding a rectangular cabinet scraper during use of the scraper on a workpiece, the scraper having a front side, a back side, top and bottom edges separated by a scraper height, and two ends, the apparatus comprising scraper holding means for holding the ends of the scraper by contact with both the front side and back side of the scraper along a substantial portion of the scraper height so that the bottom scraper edge projects from the apparatus between the scraper holding means, and means for bowing the scraper for use with contact solely between the scraper and the workpiece, and a plate between the bowing means and the scraper.

3. The apparatus of claim 2, wherein the apparatus includes a body with at least two indentations to receive a user's thumbs during use of the apparatus.

4. Apparatus for holding a rectangular cabinet scraper, the scraper having two ends, at least one working edge and a front and back surface, the apparatus comprising:

(a) a body shaped generally like an open scroll having a generally flat portion having a thickness with two roll-like body ends of greater thickness than the thickness of the generally flat portion adjacent to the body ends, (b) scraper end securing means in each body end for securing one end of the scraper in each body end so that the scraper working edge projects from the body between the scraper end securing means, and (c) means for applying pressure to the back surface of the scraper in order to bow it.

5. The apparatus of claim 4, wherein the means for applying pressure comprises a plate urged against the back surface of the scraper by a screw journalled in the body.

6. The body of claim 5, wherein the apparatus has at least two indentations to receive a user's thumbs during use of the apparatus.

7. The body of claim 4, wherein the apparatus has at least two indentations to receive a user's thumbs during use of the apparatus.

8. Apparatus for holding a cabinet scraper, the scraper having two ends and a front and back surface, the apparatus comprising:

(a) a body shaped generally like an open scroll having a generally flat portion having a thickness with two roll-like body ends of greater thickness than the thickness of the generally flat portion adjacent to the body ends, (b) scraper end securing means in each body end for securing one end of the scraper in each body end, and (c) means for applying pressure to the back surface of the scraper in order to bow it comprising a plate urged against the back surface of the scraper by a screw journalled in the body, wherein the plate is received within a recess in the body that prevents rotation of the plate.

9. Apparatus for holding a cabinet scraper, the scraper having two ends and a front and back surface, the apparatus comprising:

(a) a body shaped generally like an open scroll having a generally flat portion with two roll-like body ends, (b) scraper end securing means in each body end for securing one end of the scraper in each body end, and (c) means for applying pressure to the back surface of the scraper in order to bow it, wherein the scraper end securing means comprises (1) a ridge within the body end against which the back surface of the scraper proximate the scraper end rests and a truncated inside conical surface in each body end, and (2) a locking cone in each body end for applying pressure to the front surface of the scraper proximate the scraper end and generally opposite the ridge, the locking cone having (i) a contact surface opposite the ridge for contact with the scraper front surface, (ii) a truncated outside conical surface complimentary to the truncated inside conical surface in each body end, and (iii) means in each body end for urging the locking cone along its longitudinal axis and thereby moving the contact surface in a direction generally transverse to the ridge and the scraper front surface as sliding contact occurs between the outside conical surface of the locking cone and the inside conical surface in the body end to secure the scraper in the body.

10. Apparatus for holding a cabinet scraper, the scraper having two ends and a front and back surface, the apparatus comprising:

(a) a body shaped generally like an open scroll having a generally flat portion having a thickness with two roll-like body ends of greater thickness than the thickness of the generally flat portion adjacent to the body ends, (b) scraper end securing means in each body end for securing one end of the scraper in each body end, the scraper end securing means comprising a cylinder rotatably captured in each body end, the cylinder having at least one slot for receiving a portion of one end of the scraper, and (c) means for applying pressure to the back surface of the scraper in order to bow it.

11. Apparatus for holding a cabinet scraper, the scraper having two ends, four edges and a front and back surface, the apparatus comprising:

(a) a body shaped generally like an open scroll having a generally flat portion with two roll-like body ends, (b) means in each body end for securing one end of the scraper in the body end comprising a cylinder rotatably captured in each body end, each cylinder having two slots of different widths for selectively receiving a portion of one end of the scraper, an axial thread to receive a capscrew, and a stop for abutting against one of the edges of the scraper within the slots comprising a capscrew threaded into the cylinder, and (c) means for applying pressure to the back surface of the scraper in order to bow it.

12. Apparatus for holding a cabinet scraper, the scraper having two ends and a front and back surface, the apparatus comprising:

(a) a body shaped generally like an open scroll having a generally flat portion having a thickness with two roll-like body ends of greater thickness than the thickness of the generally flat portion adjacent to the body ends, (b) scraper end securing means in each body end for securing one end of the scraper in each body end, (c) a rectangular plate urged against the back surface of the scraper by a screw journalled in the body for applying pressure to the back surface of the scraper in order to bow the scraper, and (d) a pad mounted on the plate to bear against the scraper.

13. Apparatus for holding a rectangular cabinet scraper during use of the scraper on a workpiece, the scraper having a front side, a back side, top and bottom edges separated by a scraper height, and two ends, the apparatus comprising scraper holding means for holding the ends of the scraper by contact with both the front side and back side of the scraper along a substantial portion of the scraper height so that the bottom scraper edge projects from the apparatus between the scraper holding means, and means for bowing the scraper for use with contact solely between the scraper and the workpiece, wherein the apparatus includes a body with at least two indentations within which a user's thumbs may be positioned during use of the apparatus.

14. Apparatus for holding a rectangular cabinet scraper during use of the scraper on a workpiece, the scraper having a front side, a back side, top and bottom edges separated by a scraper height, and two ends, the apparatus comprising:

(a) an elongated body having a front side, a back side, two rounded ends and two indentations in the front side of the body for receiving a user's thumbs during use of the apparatus, (b) a screw-actuated clamp at each end of the body for holding the ends of the scraper by contact with both the front side and back side of the scraper along a substantial portion of the scraper height so that bottom edge of the scraper projects from the body, and (c) a thumb screw threaded through the body midway between the body ends to exert pressure against the back side of the scraper in order to bow it.

* * * * *